United States Patent [19]

Neelameggham et al.

[11] 4,398,947

[45] Aug. 16, 1983

[54] COATED MAGNESIUM GRANULES HAVING ANTI-CAKING PROPERTIES

[75] Inventors: Ramaswami Neelameggham, Salt Lake City, Utah; John C. Priscu, Las Vegas, Nev.

[73] Assignee: Amax Inc., Greenwich, Conn.

[21] Appl. No.: 421,890

[22] Filed: Sep. 23, 1982

[51] Int. Cl.[3] ..... C21C 7/00

[52] U.S. Cl. ..... 75/53; 75/58

[58] Field of Search ..... 75/53, 58; 148/24, 25

[56] References Cited

U.S. PATENT DOCUMENTS 1,757,118 5/1930 Harris ..... 148/25

1,882,735 10/1932 Barber ..... 148/25

*Primary Examiner*—P. D. Rosenberg

*Attorney, Agent, or Firm*—Michael A. Ciomek; Eugene J. Kalil

[57] ABSTRACT

The invention provides an article of manufacture comprising magnesium granules characterized by a surface coating of at least one anti-caking agent selected from the group consisting of magnesium, calcium and aluminum stearate.

5 Claims, No Drawings

COATED MAGNESIUM GRANULES HAVING ANTI-CAKING PROPERTIES

This invention relates to magnesium granules characterized by a surface coating having anti-caking properties.

STATE OF THE ART

Magnesium is employed as an external addition to molten iron or steel to reduce sulfur and oxygen, thus improving the physical and chemical properties of the final product.

For example, in the casting of ferrous materials it is the usual procedure to add a deoxidizing agent such as Mg, Al, etc., before casting in order to deoxidize the molten ferrous metal of absorbed oxygen which can adversely affect the physical properties of the finished product.

In addition to deoxidation, some metal products require a reduction of sulfur content which also has an adverse effect on the physical properties of finished product.

Magnesium, a strong desulfurizing agent, has been found very useful for that purpose since it is a very reactive element at elevated temperatures. When introduced under the surface of molten iron or steel at temperatures of about 2300° F. to 2700° F., the magnesium which has a boiling point of 2024.8° F., vaporizes and reacts violently with the oxygen and sulfur in the steel. The gas bubbles quickly rise to the surface along with bubbles of expanded inert carrier gases. This action is hazardous and causes molten metal to splash with the consequent loss of metal and reagent. Another problem is the tendency for superheated magnesium to react with air which results in a voluminous dense cloud of magnesium oxide dust.

It has been found convenient to add the magnesium in the form of granules coated with fused salt mixtures containing NaCl, KCl, $CaCl_2$, $MgCl_2$, and the like. These mixtures may also contain oxides of these elements. The coated granules are injected well below the molten iron or steel surface through a lance using a stream of suitable carrier gas at a rate to control the reaction violence to assure a beneficial stirring action, while minimizing loss of magnesium vapor to the atmosphere.

The salt coating is claimed to avoid plugging of the lance, to slow the rate of reaction and to better control the addition rate of the granules. Another advantage of the chloride coating is to reduce the pyrophoricity of the magnesium granules, and to protect the granules from corrosion in air in the shipping container. However, a disadvantage of these salt mixtures is that they are somewhat hygroscopic, and have a tendency to absorb moisture on exposure to air which causes "caking" of the granules. Also on long time exposure, the magnesium granule will corrode and form hydrous oxides or hydroxy chlorides.

It is known to coat magnesium granules with clay slips, bentonite, and the like, which coating tends to cause caking of the granules.

It would be desirable to provide magnesium granules which are anti-caking and which can be easily handled when employed as addition agents in carrying out various metallurgical operations.

OBJECTS OF THE INVENTION

It is thus an object of the invention to provide as an article of manufacture coated magnesium granules having anti-caking properties.

Another object of the invention is to provide magnesium granules which have a normally hygroscopic surface but which have been treated with an anti-caking agent to render the granules anti-caking.

These and other objects will more clearly appear from the following disclosure and claims.

STATEMENT OF THE INVENTION

As an article of manufacture, the invention provides magnesium granules characterized by a surface coating of at least one anti-caking agent selected from the group consisting of stearates of magnesium, calcium and aluminum.

One embodiment comprises magnesium granules having a layer of a hygroscopic chloride salt in which the granules are further characterized by a surface coating of at least one anti-caking agent selected from the group consisting of stearates of magnesium, calcium and aluminum.

Broadly, the invention is applicable to the coating of magnesium granules per se or granules having a layer selected from the group consisting of a hygroscopic chloride salt, clay slips and bentonite, the coating applied being a stearate as stated hereinabove.

The magnesium granules prior to coating have an average size generally less than 10 mesh and generally ranging from about 100 to 10 mesh U.S. standard.

The amount of stearate employed is usually less than about 1% of the total weight of the product but may range to as high as about 3% by weight.

DETAILS OF THE INVENTION

As illustrative of the various embodiments of the invention, the following examples are given:

EXAMPLE 1

In producing coated magnesium granules, about 10 lbs of the granules having a chloride layer selected from the group consisting of alkali and alkali earth metal chloride amounting to about 3% by weight are mixed with about 1% by weight of calcium stearate. The mixture is then subjected to 2 hours of milling in a rotating tumbler or concrete mixer to provide an outer surface coating of calcium stearate. The coated granules thus produced will be anti-caking. This will be evidenced by the fact that the granules will be substantially free flowing.

EXAMPLE 2

If desired, the magnesium granules may be coated with a stearate by mixing it with about 1% by weight of stearic acid, the mixing being carried out in a slowly moving ball mill. The stearic acid reacts with the surface of the magnesium granules to form magnesium stearate coatings which will protect the granules from oxidation.

The stearate coating need not be continuous so long as it is sufficient to render the granules anti-caking and provides the desired protection.

The formulas for the preferred stearates and their melting points are as follows:

| Compound | Melting Point |
|---|---|
| $Ca(C_{18}H_{35}O_2)_2$ | 180° C. |
| $Al(C_{18}H_{35}O_2)_2$ | 103° C. |
| $Mg(C_{18}H_{35}O_2)_2$ | 88° C. |

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. As an article of manufacture, an addition agent in the form of free flowing magnesium granules characterized by a surface coating of at least one anti-caking agent selected from the group consisting of stearates of magnesium, calcium and aluminum.

2. In magnesium granules for use as an addition agent in carrying out metallurgical processes, said granules having a layer of material selected from the group consisting of hygroscopic chloride salts, clay slips and bentonite, the improvement wherein said granules are further characterized by a surface coating of at least one anti-caking agent selected from the group consisting of stearates of magnesium, calcium and aluminum.

3. As an article of manufacture, an addition agent in the form of free flowing magnesium granules having a layer of hygroscopic chloride salt, said granules being further characterized by a surface coating of at least one anti-caking agent selected from the group consisting of stearates of magnesium, calcium and aluminum.

4. The magnesium granules of claim 1, wherein the granules without the coating have an average size ranging from about 100 to 10 mesh.

5. As an article of manufacture, magnesium granules having a layer of a material selected from the group consisting of a hygroscopic chloride salt, clay slips and bentonite, said granules being further characterized by a surface coating of an effective amount of at least one anti-caking agent selected from the group consisting of stearates of magnesium, calcium and aluminum, said effective amount ranging up to about 3% by weight of the total weight of the granules.

* * * * *